US009044088B2

(12) United States Patent
Greussing

(10) Patent No.: US 9,044,088 B2
(45) Date of Patent: Jun. 2, 2015

(54) PULL-OUT GUIDE FOR DRAWERS

(71) Applicant: Julius Blum GmbH, Hochst (AT)

(72) Inventor: Ulrich Greussing, Bizau (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 13/741,749

(22) Filed: Jan. 15, 2013

(65) Prior Publication Data

US 2013/0127320 A1 May 23, 2013

Related U.S. Application Data

(63) Continuation of application No. PCT/AT2011/000293, filed on Jul. 5, 2011.

(30) Foreign Application Priority Data

Aug. 23, 2010 (AT) ..... A 1402/2010

(51) Int. Cl.
*A47B 88/04* (2006.01)
*A47B 88/10* (2006.01)

(52) U.S. Cl.
CPC ..... *A47B 88/04* (2013.01); *A47B 2210/0064* (2013.01); *A47B 88/10* (2013.01); *A47B 2210/0013* (2013.01); *A47B 2210/0032* (2013.01); *A47B 2210/0059* (2013.01); *A47B 2210/0075* (2013.01); *A47B 2210/0089* (2013.01)

(58) Field of Classification Search
CPC ..... A47B 2210/0013; A47B 2210/007
USPC ..... 312/319.1, 319.5, 319.7, 330.1, 331, 312/334.1, 334.7, 334.8, 334.13, 334.32; 16/49, 64, 71, 79
See application file for complete search history.

(56) References Cited

U.S. PATENT DOCUMENTS 1,067,404 A * 7/1913 Callaghan ..... 312/331
5,135,294 A * 8/1992 Ohshima et al. ..... 312/319.1
6,666,306 B2 * 12/2003 Gasser ..... 188/82.1

(Continued)

FOREIGN PATENT DOCUMENTS

CN 101516234 8/2009
CN 201299316 Y * 9/2009 ..... A47B 88/10

(Continued)

OTHER PUBLICATIONS

DE102005016418 Translation.*

(Continued)

*Primary Examiner* — Daniel J Troy
*Assistant Examiner* — Andrew Roersma
(74) *Attorney, Agent, or Firm* — Wenderoth, Lind & Ponack, L.L.P.

(57) ABSTRACT

A pull-out guide for drawers includes a body rail to be fastened to a furniture body, a drawer rail to be fastened to the drawer, and a center rail movably mounted between the body rail and the drawer rail. The relative motion sequence of the rails is determined by a forced control unit, and the forced control unit has a synchronization wheel designed as a gear wheel, the synchronization wheel interacting with a running surface arranged or formed on the rails and/or with a running surface of a carriage, which is slidably mounted between the rails. An overload protection device is provided for reversibly lifting the forced control unit of the rails.

23 Claims, 5 Drawing Sheets

(56) References Cited

U.S. PATENT DOCUMENTS

| | | | | |
|---|---|---|---|---|
| 2001/0008358 | A1* | 7/2001 | Brustle | 312/319.1 |
| 2004/0145284 | A1* | 7/2004 | Egger | 312/331 |
| 2008/0211365 | A1* | 9/2008 | Moll et al. | 312/319.1 |
| 2010/0045153 | A1* | 2/2010 | Ritter | 312/334.1 |
| 2010/0090571 | A1 | 4/2010 | Gasser | |
| 2011/0009198 | A1* | 1/2011 | Yang et al. | 464/46 |

FOREIGN PATENT DOCUMENTS

| | | | | |
|---|---|---|---|---|
| CN | 101606788 | | 12/2009 | |
| CN | 101683217 | | 3/2010 | |
| DE | 43 12 425 | | 10/1994 | |
| DE | 102004002823 | A1 * | 8/2005 | A47B 88/10 |
| DE | 10 2005 016 418 | | 11/2005 | |
| EP | 1 452 113 | | 9/2004 | |
| JP | 3-45744 | | 4/1991 | |
| JP | H05248448 | A * | 9/1993 | F16D 7/02 |
| JP | 11-94455 | | 4/1999 | |
| JP | 2006-122150 | | 5/2006 | |
| JP | 2008-522690 | | 7/2008 | |
| JP | 3151357 | | 5/2009 | |
| JP | 3154757 | | 9/2009 | |

OTHER PUBLICATIONS

CN201299316 Translation.pdf.*

International Search Report issued Nov. 2, 2011 in International (PCT) Application No. PCT/AT2011/000293.

Austrian Patent Office Search Report completed Apr. 19, 2011 in Austrian Patent Application No. A 1402/2010.

Verified English translation of DE 10 2005 016 418.

Chinese Office Action (OA) issued Apr. 1, 2014 in corresponding Chinese Patent Application No. 201180035971.4.

* cited by examiner

PULL-OUT GUIDE FOR DRAWERS

BACKGROUND OF THE INVENTION

The present invention concerns an extension guide for drawers comprising a carcass rail to be fixed to a furniture carcass, a drawer rail to be fixed to the drawer, and a central rail mounted movably between the carcass rail and the drawer rail. The relative movement sequence of the rails is determined by a positive control, and the positive control has a synchronization wheel which is in the form of a gear and which cooperates with a running surface arranged or formed on the rails and/or with a running surface of a carriage mounted displaceably between the rails.

The invention further concerns an article of furniture having a drawer extension guide of the kind to be described.

Positive controls of a drawer extension guide serve to exactly establish the relative movement sequence of the rails and/or the relative movement sequence of carriages mounted between the rails. In this connection, numerous configurations of such positive controls are known (for example DE 10 2005 016 418 A1), wherein either the movement sequence of the rails relative to each other, the movement sequence of the rails relative to the carriages, or the movement sequence of carriages which are displaceably mounted on the one hand between the carcass rail and the central rail and on the other hand between the central rail and the drawer rail is controlled. Examples of positive controls are rack-and-pinion arrangements controlling the relative movements of the rails and/or the carriages. When using such positive control systems, however, there is the danger that blocking or non-synchronous movement of a moveable rail can lead to destruction of the positive control—in particular breakage of the rack-and-pinion arrangement. Transport of the drawer extension guide as well as abusive handling (intentional improper operation of or dropping the drawer extension guide) can lead to such damage so that the drawer extension guide is no longer properly operable.

SUMMARY OF THE INVENTION

Therefore the object of the present invention is to provide a drawer extension guide of the general kind set forth in the opening part of this specification, avoiding the above-indicated disadvantage.

According to the invention, the object is attained by the features of the present invention. Further advantageous configurations of the invention are also described below.

According to the invention, it is therefore provided that there is an overload protection means by which the positive control of the rails can be reversibly cancelled.

The present invention is therefore based on the fundamental notion of interrupting the flow of force that acts on a positive control mechanism when a predetermined threshold value is exceeded in order to prevent overloading of or damage to the positive control. After the flow of force is interrupted, the overload protection means can re-establish the flow of force if the force or the torque is again within a tolerable range or is of a tolerable value.

In that case, the positive control mechanism acts in positively locking fashion. Therefore, a slip-free movement can be transmitted by the positive control between the components of the drawer extension guide, that are to be synchronized.

In a first embodiment, the positive control is operative between the rails of the extension guide. In that case, therefore, the positive control mechanism cooperates with the rails—in particular with running surfaces thereof—thereby establishing the movement sequence thereof.

In a second embodiment of the invention, the positive control mechanism acts, on the one hand, on a carriage mounted movably between the rails and, on the other hand, on at least one rail. Coupling a rail to at least one carriage mounted between the rails means that it is possible to indirectly establish the relative movement sequence of the rails (by way of the movement of a carriage). In that respect, a possible embodiment provides that the positive control cooperates, on the one hand, with a carriage mounted displaceably between the rails and on the other hand with a running surface arranged on one of the rails—in particular also by way of a rack.

In a third embodiment of the invention, the positive control mechanism acts, on the one hand, on a carriage mounted displaceably between the carcass rail and the central rail and, on the other hand, on a carriage mounted displaceably between the central rail and the drawer rail. In that case, therefore, the relative movement sequence of a carriage arranged between the carcass rail and the central rail and a carriage arranged between the central rail and the drawer rail is established. The movements of the rails relative to each other are therefore established indirectly by way of the movement of the carriages.

There are very many different possible options for implementing the overload protection. In an embodiment of the invention, the overload protection means has at least one—preferably self-switching—coupling which provides for decoupling the positive control as from a predetermined threshold value. In this connection it is advantageously possible, for example, to use slipper couplings which reversibly interrupt the flow of force without an outside influence when a defined torque is reached. In this connection, numerous couplings in accordance with the state of the art are available to the man skilled in the art to implement such a coupling.

Slipper couplings are known, for example, in which the overload protection is embodied by a metal spring which slips as from a predetermined torque between the parts of the coupling, thereby producing a decoupling effect. Centrifugal couplings are also known, which disengage as from a given torque. There are also couplings with spring-loaded coupling members which interrupt the flow of force therethrough, after the spring force is overcome. It is also possible to use magnetic couplings by which transmission of force or torque can be reversibly interrupted when a threshold value is exceeded.

In a possible embodiment of the invention, the coupling is in the form of a slipper coupling having at least two latching wheels which remain in their relative position with respect to each other below a predetermined torque and which are rotatable relative to each other above a predetermined torque. In this connection, it may be desirable if the latching wheels are in positively locking and/or force-locking relationship with each other by way of cooperating points or spikes, tooth arrangements, groove configurations and/or projections. In a possible embodiment, a first latching wheel having an external tooth arrangement is fitted into a second latching wheel having an internal tooth arrangement. Those latching wheels are therefore connected together at least partially in positively locking relationship and/or at least partially in force-locking relationship and are rotatable relative to each other when a predetermined torque is exceeded, thereby providing the required overload protection.

In an embodiment, the two latching wheels can also be formed from plastic of differing hardness. Therefore, a first latching wheel is more flexible than a second latching wheel, and decoupling of the two latching wheels can be produced by virtue of the flexible nature of a latching wheel. In normal operation, the two latching wheels are connected together in play-free relationship and can move relative to each other only when an admissible torque is exceeded. An advantage of this configuration is that the coupling can be formed completely from plastic which can be produced without any problem and inexpensively in an injection molding process. The use of a plastic coupling means that it is possible to dispense with additional parts such as metal springs and additional—in particular spring-loaded—coupling elements for selectively interrupting and establishing the flow of force. Particularly compact or space-saving structural designs can be implemented by making the coupling completely from plastic.

The article of furniture according to the invention has at least one drawer which is mounted displaceably relative to a furniture carcass by way of an extension guide of the kind in question.

BRIEF DESCRIPTION OF THE DRAWINGS

Further details and advantages of the present invention are described by means of the specific description hereinafter. In the drawings.

DETAILED DESCRIPTION OF THE INVENTION

Figure 1:
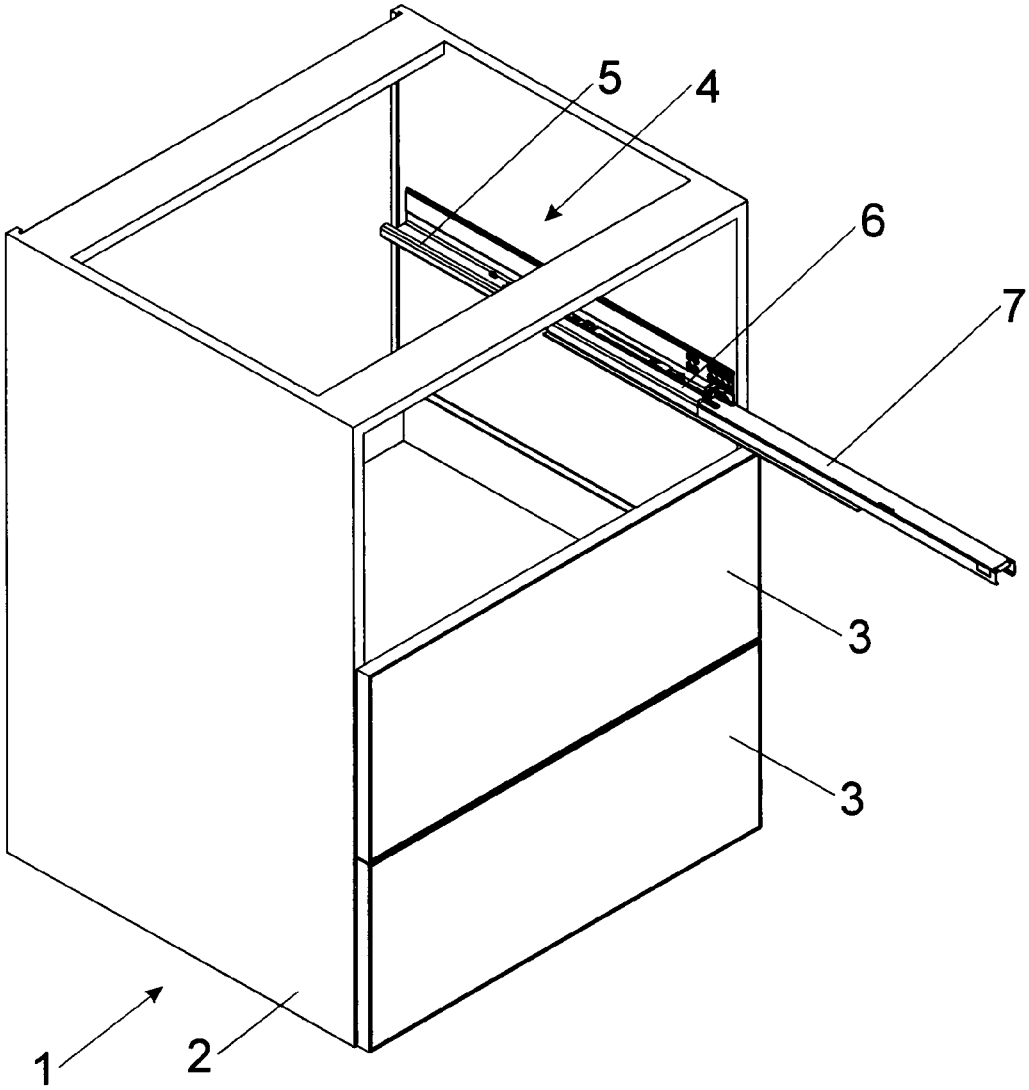
FIG. 1 is a perspective view of an article of furniture with drawers mounted displaceably relative to a furniture carcass by way of drawer extension guides.

FIG. 1 shows a perspective view of an article of furniture 1 wherein drawers 3 are mounted displaceably relative to a carcass 2 by way of drawer extension guides 4. In the illustrated embodiment, the drawer extension guide 4 is in the form of a full-extension arrangement and has a carcass rail 5 to be fixed to the furniture carcass 2, a central rail 6 displaceable relative to the carcass rail, and an extendable drawer rail 7. The drawer rail 7 is to be connected to a respective one of the drawers 3. Arranged between the carcass rail 5 and the central rail 6 is at least one first displaceable carriage and arranged between the central rail 6 and the drawer rail is at least one second displaceable carriage, although the carriages cannot be seen in the illustrated Figure. As is known per se, the carriages have rolling bodies for transmitting the load of the drawer 3. By means of a positive control mechanism, it is possible to prevent incorrect movements of the rails 6, 7 and/or incorrect movements of carriages which are mounted displaceably between the rails 5, 6, 7.

Figure 2A:
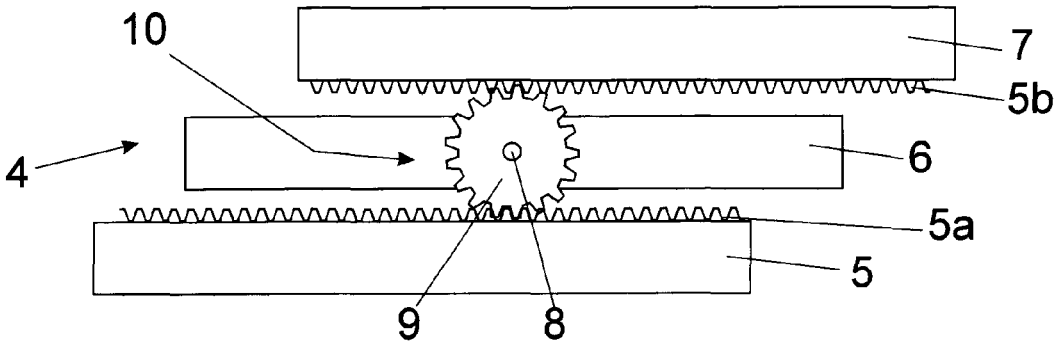
FIGS. 2*a*-2*d* are highly diagrammatic views of drawer extension guides, wherein the positive control is operative between the rails, between a carriage and a rail and between two carriages of the extension guide.

FIG. 2*a* shows a highly diagrammatic side view of a drawer extension guide 4, wherein the carcass rail 5 which is arranged stationarily in the mounted position, the drawer rail 7 to be fixed to the drawer 3, and the central rail 6 mounted displaceably between the carcass rail 5 and the drawer rail 7 can be seen here. In the illustrated embodiment, the positive control mechanism 10 has a synchronization wheel 9 mounted rotatably to the central rail 6—preferably at a horizontal shaft 8. The synchronization wheel 9 cooperates, on the one hand, with a running surface 5*a* of the carcass rail 5 and on the other hand with a second running surface 5*b* of the drawer rail 7. In that way, during its movement, the drawer rail 7 can move at approximately twice the speed of the central rail 6. The synchronization wheel 9 is in the form of a gear wheel cooperating with running surfaces 5*a*, 5*b* in the form of toothed racks or toothed bars.

Figure 2B:
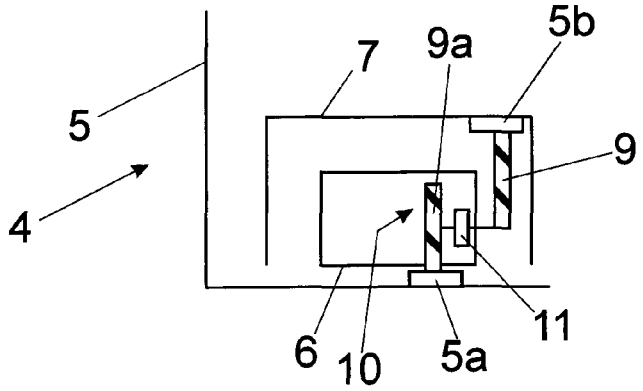

FIG. 2*b* shows a diagrammatic cross-sectional view of an extension guide 4, showing the carcass rail 5, the central rail 6, and the drawer rail 7. As in FIG. 2*a*, in this case the relative movement sequence of the rails 5, 6, 7 is also established by a positive control mechanism 10, wherein a first synchronization wheel 9 cooperates, on the one hand, with the second running surface 5*b* of the drawer rail 7 and a second synchronization wheel 9*a* cooperates with a running surface 5*a* of the carcass rail 5. The two synchronization wheels 9, 9*a* are motionally coupled together (i.e., when one wheel rotates, the other wheel rotates). The invention now provides that the positive control mechanism 10 can be reversibly revoked or deactivated by an overload protection device 11 if the force acting on the positive control mechanism 10, or the torque which occurs, exceeds a predetermined threshold value. If, therefore, the central rail 6 is blocked in its movement by an object, the overload protection device 11 triggers, whereby the central rail 6 is decoupled from the movement of the drawer rail 7 and damage to the positive control mechanism 10 is thus prevented. Blocking of the moveable rails 6, 7 can be in particular also triggered by items stowed in the furniture carcass 2.

Figure 2C:
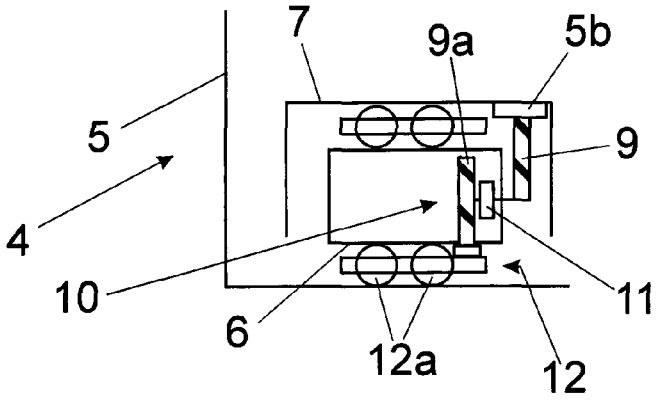

FIG. 2*c* shows an alternative positive control mechanism 10, wherein a first synchronization wheel 9 cooperates on the one hand with a running surface 5*b* of the drawer rail 7 and a second synchronization wheel 9*a* cooperates with at least one carriage 12 mounted displaceably between the carcass rail 5 and the central rail 6. The carriage 12 has in known fashion a plurality of rolling bodies 12*a* provided for transmitting the load of the drawer 3. The two synchronization wheels 9, 9*a* are motionally coupled to each other, but in this case the flow of force can be reversibly disconnected by way of an overload protection device 11.

Figure 2D:
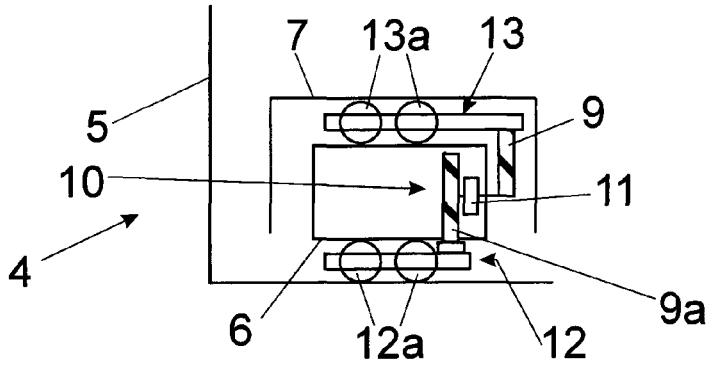

FIG. 2*d* shows a further possible embodiment of a positive control 10 which cooperates on the one hand with a first carriage 12 mounted displaceably between the carcass rail 5 and the central rail 6 and on the other hand with a second carriage 13 mounted displaceably between the central rail 6 and the drawer rail 7. The two carriages 12, 13 have rolling bodies 12*a*, 13*a*. The synchronization wheels 9, 9*a* operative between the carriages 12, 13 are motionally coupled together, but can be uncoupled from each other by an overload protection device 11 when a defined force or a predetermined torque is exceeded. The relative movements of the rails 5, 6, 7 can be indirectly established by positive coupling of the two carriages 12, 13.

Figure 3A:
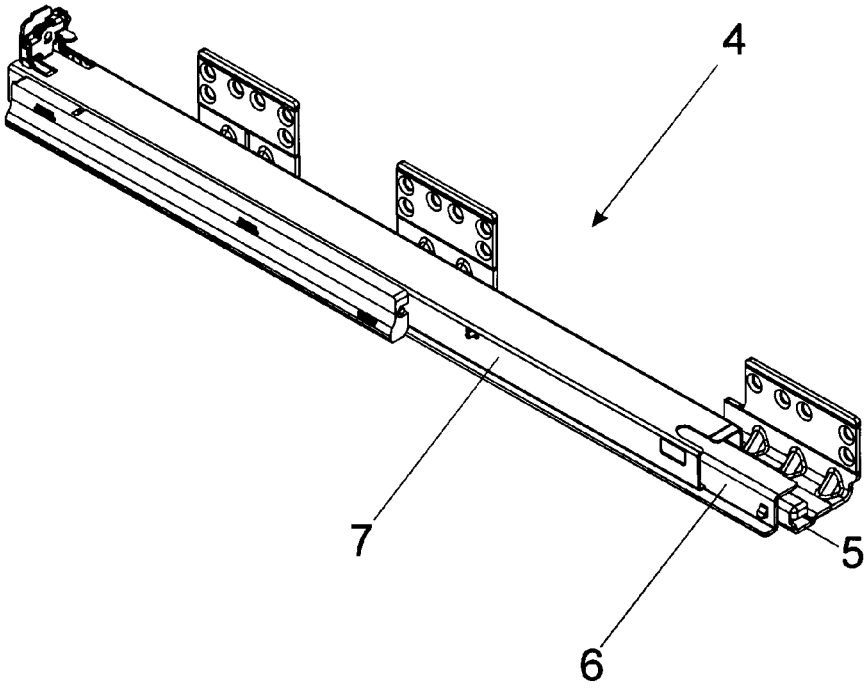
FIGS. 3*a* and 3*b* are a perspective view of a drawer extension guide and an enlarged sectional view thereof, respectively.

FIG. 3*a* shows a perspective view of an extension guide 4 with the carcass rail 5 to be fixed to the furniture carcass 2 (FIG. 1), wherein at least one central rail 6 and a drawer rail 7 are mounted displaceably relative to the carcass rail 5.

Figure 3B:
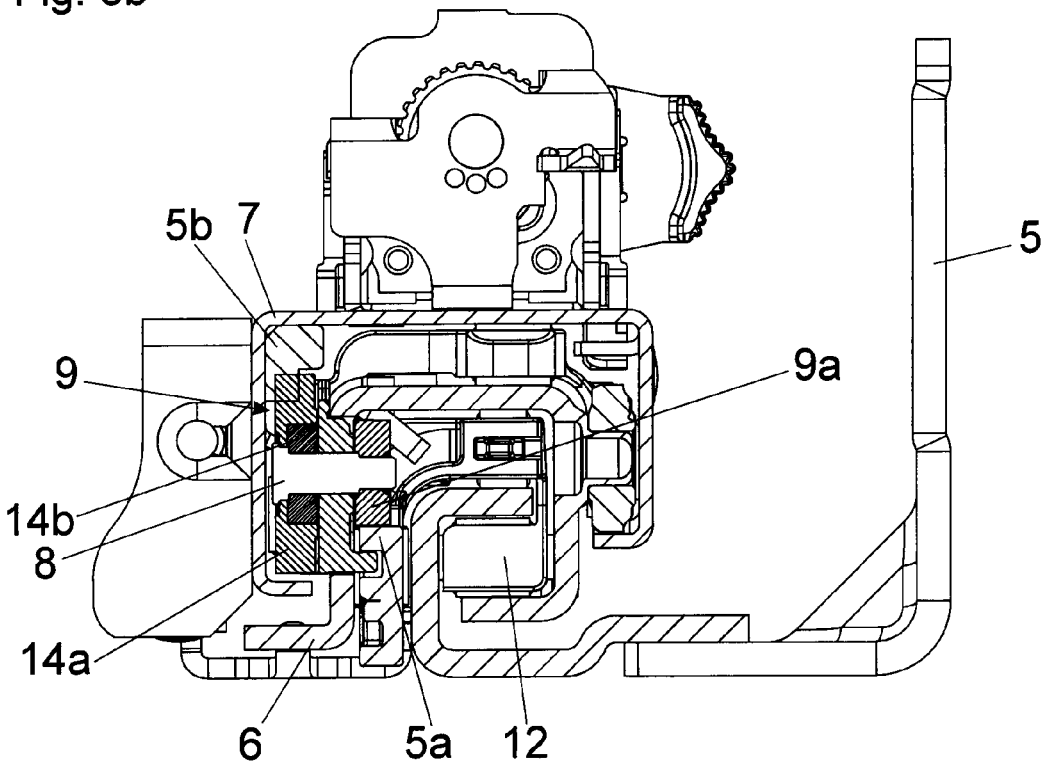

FIG. 3*b* shows a sectional view of the extension guide 4 with the carcass rail 5, the central rail 6, and the drawer rail 7.

The second running surface 5*b*—for example in the form of a toothed rack—is arranged or formed at the underside of the drawer rail 7 and cooperates with the first synchronization wheel 9 mounted rotatably to the central rail 6. The first synchronization wheel 9 is mounted at a first end of the shaft 8 which passes through the central rail 6 at an opening. Mounted at a second opposite end of the shaft 8 is a second synchronization wheel 9*a* which cooperates with the carriage 12 mounted displaceably between the carcass rail 5 and the central rail 6, by way of the first running surface 5*a* in the form of a toothed rack, which is arranged or formed on the carriage 12. It will be seen that the first synchronization wheel 9 is at least of a two-part configuration and includes first and second latching wheels 14*a* and 14*b* which are fitted one into the other and which are connected to each other by way of static friction and/or by way of at least a partial positively locking connection. The (second) inner synchronization wheel 9*a* is connected non-rotatably to the second latching wheel 14*b* by way of the shaft 8. In normal operation, no relative movement takes place between the two latching wheels 14*a*, 14*b*. That is to say, upon a movement of the drawer rail 7, the first synchronization wheel 9 and the second synchronization wheel 9*a* move at the same speed. However, when a defined torque is exceeded, the two latching wheels 14*a*, 14*b* can rotate relative to each other whereby the flow of force between the two synchronization wheels 9, 9*a* is reversibly interrupted.

Figure 4:
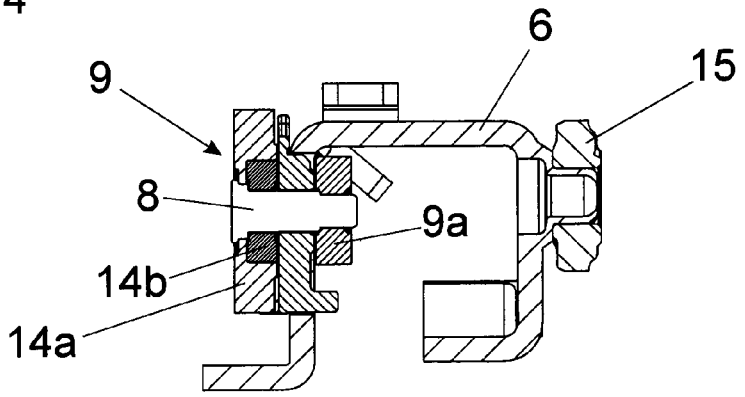
FIG. 4 shows a synchronization wheel mounted to the central rail, the overload protection means being part of that synchronization wheel.

FIG. 4 shows a cross-section through the central rail 6, wherein the first synchronization wheel 9 is mounted on an outside of the central rail 6 and has the two latching wheels 14*a* and 14*b*. In the illustrated embodiment, the first synchronization wheel 9 can cooperate with the second running surface 5*b* on the drawer rail 7, while the smaller second synchronization wheel 9*a* mounted at the opposite end of the shaft 8 can cooperate with a carriage 12 mounted displaceably between the carcass rail 5 and the central rail 6. It is also possible to see a support roller 15 which is mounted to the central rail 6 and which is provided for guiding and supporting the drawer rail 7.

Figure 5:
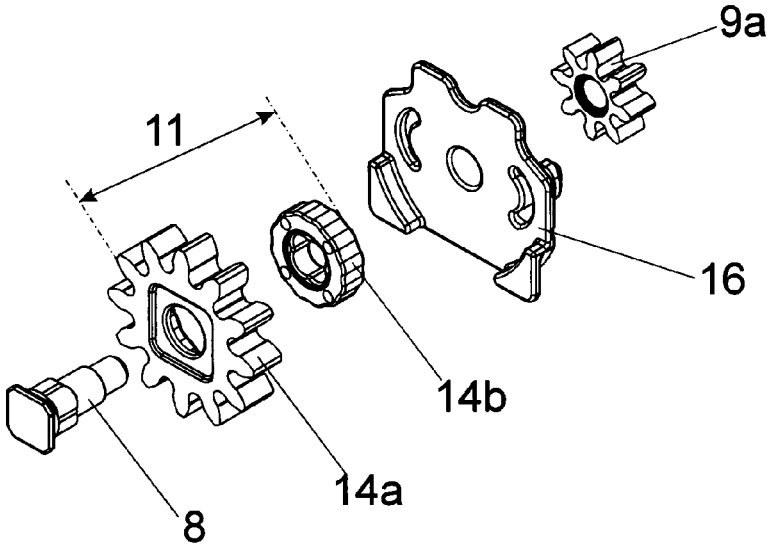
FIG. 5 is a perspective exploded view of a part of the positive control with integrated overload protection means.

FIG. 5 shows an exploded view of a part of the positive control mechanism 10 arranged in the mounted position by a mounting portion 16 on the central rail 6. The second synchronization wheel 9*a* cooperating with the carriage 12 is mounted on an inside of the central rail 6, while the first synchronization wheel 9 is carried on a common shaft 8 on an outside of the central rail 6. The first synchronization wheel 9 includes the two latching wheels 14*a* and 14*b* which are in engagement with each other by way of static friction and/or a positively locking connection. The inner (second) latching wheel 14*b* has a non-circular cross-section, and the peripheral surface of the latching wheel 14*b* in cross-section can be in the shape of a polygon. The latching wheel 14*b* is fitted substantially completely into the outer (first) latching wheel 14*a* and is in engagement therewith by way of cooperating tooth arrangements or grooves. When a predetermined torque is exceeded, the two latching wheels 14*a*, 14*b* slip relative to each other, whereby the flow of force between the synchronization wheels 9, 9*a* is interrupted.

Figure 6A:
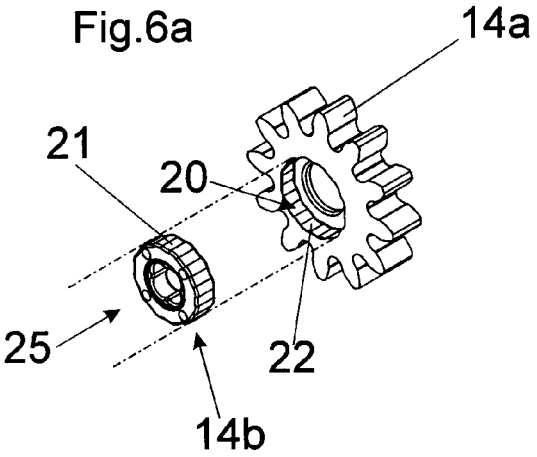
FIGS. 6*a* and 6*b* shows a coupling by way of example with two latching wheels to be connected together and a perspective view of a positive control, respectively.
Figure 6B:
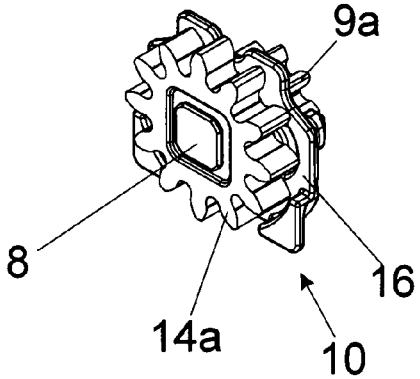

FIG. 6*a* shows a perspective view of the coupling 25 comprising the two latching wheels 14*a* and 14*b*, wherein the latching wheel 14*b* is to be fitted in a recess 20 in the latching wheel 14*a*. In the mounted position, the outer surface 21 of the second latching wheel 14*b* is connected to an inner surface 22 of the recess 20 wherein that connection can be at least partially a positively locking connection and/or at least a force-locking connection. When a tolerable torque is exceeded, the two latching wheels 14*a*, 14*b* can rotate relative to each other whereby the flow of force can be reversibly interrupted. FIG. 6*b* shows a perspective view of a part of the positive control 10. In the position of use, the two latching wheels 14*a*, 14*b* are rotatable relative to each other in the overload situation, but are arranged axially immovably relative to each other.

Figure 7A:
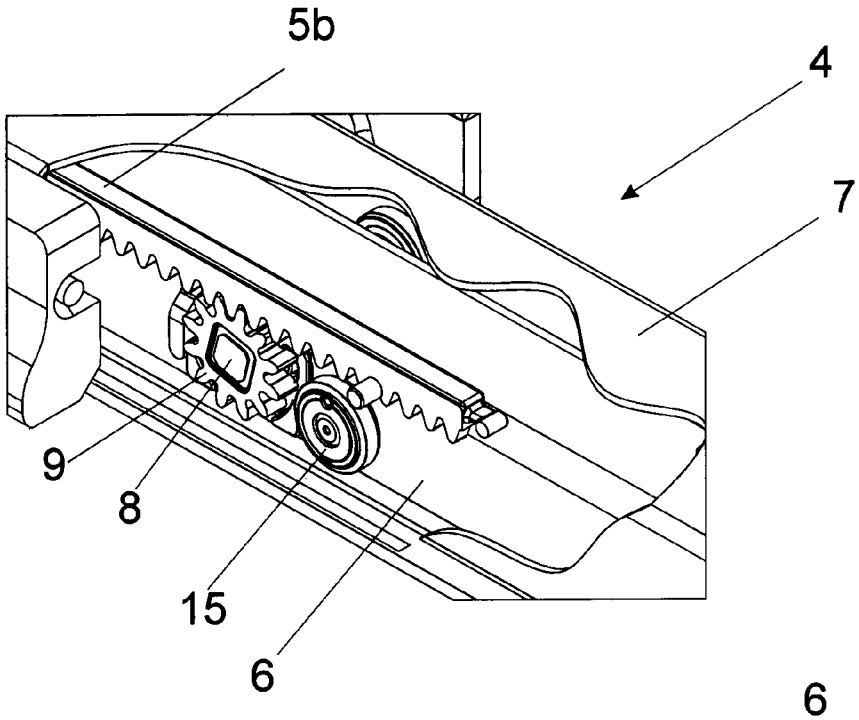
FIGS. 7*a* and 7*b* show a partly broken-away perspective view and a perspective sectional view of a portion of the drawer extension guide, respectively.

FIG. 7*a* shows a perspective view of a portion of the extension guide 4, illustrating the drawer rail 7 in a partially broken-away view. It is possible to see the rotably mounted first synchronization wheel 9 in the form of a gear cooperating with the first running surface 5*b* in the form of a rack, arranged at the underside of the drawer rail 7. The first synchronization wheel 9 can have the described overload protection device 11, but it will be appreciated that it is possible for the overload protection device 11 to be arranged at other locations along the train of force transmission—also separated from the synchronization wheel 9.

An alternative possible embodiment of an overload protection device 11 provides that the synchronization wheel 9 is designed without the described latching wheels 14*a*, 14*b*. Instead, a toothed rack in the form of a running surface 5*a*, 5*b* is arranged displaceably relative to that rail to which it is fixed. In that case, the rack can be held in a first position by a—preferably force-exerting—holding device, and the rack, after the force is overcome and the holding device is released, is movable into a second position which is displaced relative to the first position in the longitudinal direction of the rails 5, 6, 7. In this embodiment, therefore, when a predetermined force is exceeded, uncoupling is brought about by displacement of the rack relative to the rail to which it is fixed. To guide the rack, there can be provided on the rail 5, 6, 7 a guide along which the rack is linearly movable after triggering of the overload protection means 11 has occurred.

Figure 7B:
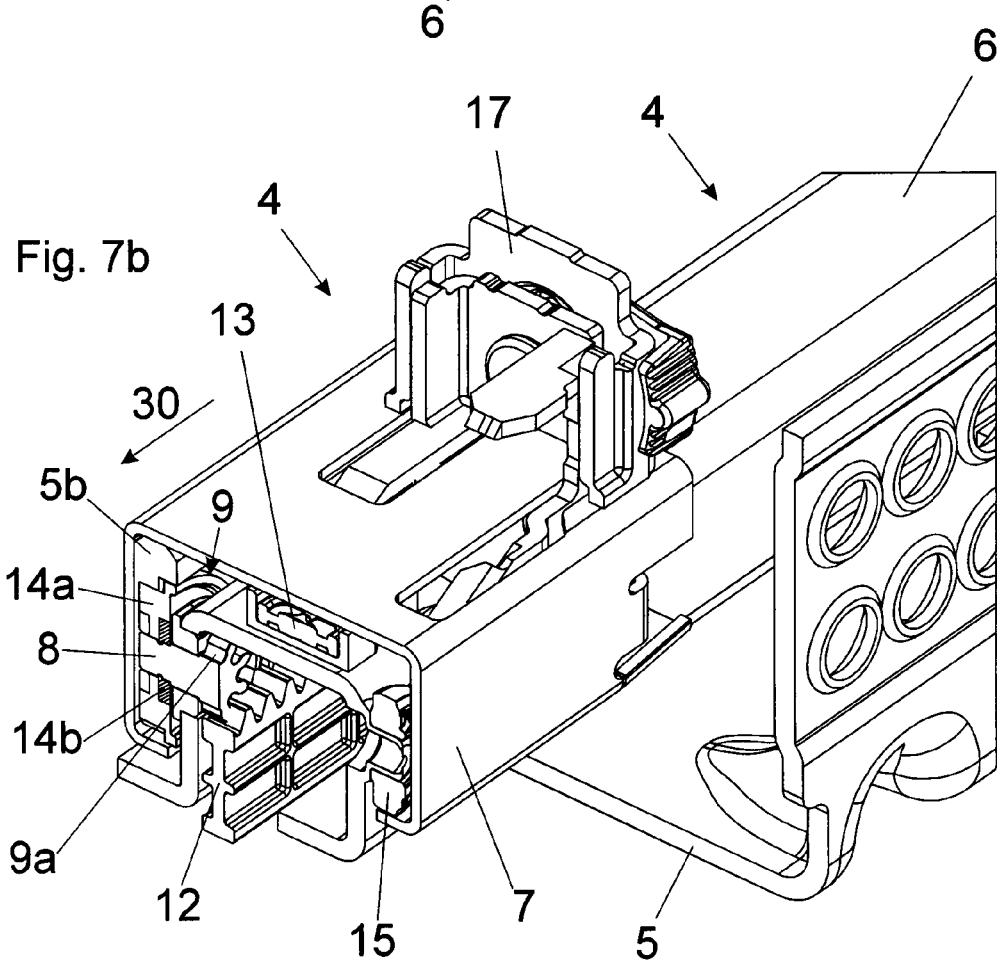

FIG. 7*b* shows a perspective view in cross-section of the drawer extension guide 4, wherein the drawer rail 7 which is displaceable in the extension direction X is in the completely open position. In the rear end region, the drawer rail 7 has a mounting element 17 which is known in accordance with the state of the art and which is provided as a means for limiting the push-in movement of the drawer 3 upon mounting thereof to the drawer extension guide 4 and for positional adjustment of the rear region of the drawer 3 so that the outward gap pattern and alignment of the drawer 3 is adjustable. Fixed at the underside of the drawer rail 7 is the second running surface 5*b* in the form of a rack which can extend in the extension direction 30 of the drawer rail 3 from the rear end region thereof over more than half the length of the drawer rail 3. Mounted on the central rail 6 is the first synchronization wheel 9 cooperating with the running surface 5*b* of the drawer rail 7. The synchronization wheel 9 is mounted to a—preferably horizontal—shaft 8 passing through the central rail 6 at an opening.

The latching wheel 14*b* forming part of the overload protection device 11 is also clearly visible. In addition, mounted to the shaft 8 is the smaller second synchronization wheel 9*a* cooperating with a rack which is arranged or formed on the carriage 12. It is also possible to see the upper carriage 13 which is mounted displaceably between the central rail 6 and the drawer rail 7 and the support roller 15 mounted rotatably to the central rail 6.

To correct any incorrect positioning of the rails 5, 6, 7 and/or the carriages 12, 13 again after triggering of the overload protection device 11 has been effected, the extension guide 4 is moved by a user either into the completely open position or the completely closed position. In that way, the carriages 12, 13 are moved either to a front or a rear end abutment of the extension guide 4, in which case the overload protection device 11 permits correction of the control without gears, racks and/or cable arrangements being damaged in that case.

The present invention is not limited to the illustrated embodiments, and includes or extends to all variants and technical equivalents which can fall within the scope of the appended claims. The positional references adopted in the description such as for example "up", "down", "lateral" and so forth are also related to the usual position of installation of the components used and the illustrated Figure and are to be appropriately transferred to the new position upon a change in position.

The invention claimed is:

1. An extension guide for a drawer, comprising:

a set of rails including a carcass rail to be fixed to a furniture carcass, a drawer rail to be fixed to the drawer, and a central rail mounted movably between said carcass rail and said drawer rail;

a carriage mounted displaceably between two rails of said set of rails;

a positive control mechanism for synchronizing a relative movement sequence of said set of rails, said positive control mechanism including a first synchronization wheel in the form of a pinion gear cooperating with a first running surface on a first one of said set of rails or said carriage, and a second synchronization wheel in the form of a pinion gear cooperating with a second running surface on a second one of said set of rails or said carriage, said first synchronization wheel and said second synchronization wheel being motionally coupled together, said first synchronization wheel being located at a first side of a limb portion of said central rail and said second synchronization wheel being located at a second side of said limb portion of said central rail opposite said first side such that said first synchronization wheel and said second synchronization wheel are separated from each other by said limb portion of said central rail, said first synchronization wheel and said second synchronization wheel being connected by a shaft extending through said limb portion of said central rail; and an overload protection device configured to operate between said first synchronization wheel and said second synchronization wheel so as to uncouple and desynchronize the relative movement sequence of said set of rails when a predetermined torque acting on said first synchronization wheel and said second synchronization wheel is exceeded wherein said overload protection device comprises a coupling including a first latching wheel and a second latching wheel configured to remain in position relative to each other below the predetermined torque, said first latching wheel and said second latching wheel being made of plastic having different hardnesses so that said first latching wheel is more flexible than said second latching wheel to allow uncoupling of said first latching wheel from said second latching wheel above the predetermined torque.

2. The extension guide according to claim 1, wherein said positive control mechanism is configured to operate between two of said set of rails.

3. The extension guide according to claim 1, wherein said positive control mechanism is configured to act on said carriage and on said first running surface on said first one of said set of rails.

4. The extension guide according to claim 1, wherein said carriage is a first carriage mounted displaceably between said carcass rail and said central rail, said extension guide further comprising a second carriage mounted displaceably between said central rail and said drawer rail, said positive control mechanism being configured to cooperate with said first carriage and with said second carriage.

5. The extension guide according to claim 1, wherein said overload protection device has a self-switching coupling.

6. The extension guide according to claim 5, wherein said coupling comprises at least two latching wheels configured to remain in position relative to each other below the predetermined torque, said at least two latching wheels being rotatable relative to each other above the predetermined torque.

7. The extension guide according to claim 6, wherein said at least two latching wheels are connected to each other by one of static friction, an at least partial positively-locking connection, or a combination of static friction and said at least partial positively-locking connection.

8. The extension guide according to claim 6, wherein a first one of said at least two latching wheels is inserted within a recess in a second one of said at least two latching wheels.

9. The extension guide according to claim 8, wherein said first one of said at least two latching wheels has an outer surface connected to an inner surface of said second one of said at least two latching wheels.

10. The extension guide according to claim 1, wherein said first synchronization wheel is rotatably mounted on said shaft extending through said central rail, said overload protection device being formed at least partly of said pinion gear of said first synchronization wheel.

11. The extension guide according to claim 1, wherein said first synchronization wheel and said second synchronization wheel are coupled together so as to rotate at the same speed and at the same times when the predetermined torque is not exceeded.

12. An article of furniture comprising:

a furniture carcass;

a drawer mounted displaceably relative to said furniture carcass; and said extension guide of claim 1 for mounting said drawer to said furniture carcass.

13. The extension guide according to claim 1, wherein said overload protection device includes:

a first latching wheel having a recess forming an inner circumferential surface coaxial with said shaft, and having an outer circumferential surface with teeth forming said first synchronization wheel; and a second latching wheel connected to said second synchronization wheel such that said second latching wheel is non-rotatable with respect to said second synchronization wheel, said second latching wheel being arranged within said recess of said first latching wheel such that an outer circumferential surface of said second latching wheel meshes with said inner circumferential surface of said first latching wheel.

14. The extension guide according to claim 13, wherein said inner circumferential surface of said first latching wheel and said outer circumferential surface of said second latching wheel are configured to:

remain engaged with each other so that no relative movement between said first latching wheel and said second latching wheel occurs when a torque no greater than a predetermined torque is applied between said first synchronization wheel and said second synchronization wheel, and disengage from each other so that said first latching wheel rotates relative to said second latching wheel when a torque greater than a predetermined torque is applied between said first synchronization wheel and said second synchronization wheel.

15. An extension guide for a drawer, comprising:

a set of rails including a carcass rail to be fixed to a furniture carcass, a drawer rail to be fixed to the drawer, and a central rail mounted movably between said carcass rail and said drawer rail;

a carriage mounted displaceably between two rails of said set of rails;

a positive control mechanism for synchronizing a relative movement sequence of said set of rails, said positive control mechanism including a first synchronization wheel in the form of a pinion gear engaging only a first running surface on only a first one of said carcass rail, said drawer rail, said central rail, or said carriage, and a second synchronization wheel in the form of a pinion gear engaging only a second running surface on only a second one of said carcass rail, said drawer rail, said central rail, or said carriage, said first one being different from said second one, said first synchronization wheel and said second synchronization wheel being motionally coupled together; and an overload protection device configured to operate between said first synchronization wheel and said second synchronization wheel to uncouple and desynchronize the relative movement sequence of said set of rails when a predetermined torque acting on said first synchronization wheel and said second synchronization wheel is exceeded said first synchronization wheel being located at a first side of a limb portion of said central rail and said second synchronization wheel being located at a second side of said limb portion of said central rail opposite said first side such that said first synchronization wheel and said second synchronization wheel are separated from each other by said limb portion of said central rail, said first synchronization wheel and said second synchronization wheel being connected by a shaft extending through said limb portion of said central rail.

16. The extension guide according to claim 15, wherein said overload protection device has a self-switching coupling.

17. The extension guide according to claim 16, wherein said coupling comprises at least two latching wheels configured to remain in position relative to each other below the predetermined torque, said at least two latching wheels being rotatable relative to each other above the predetermined torque.

18. The extension guide according to claim 17, wherein said at least two latching wheels are connected to each other by one of static friction, an at least partial positively-locking connection, or a combination of static friction and said at least partial positively-locking connection.

19. The extension guide according to claim 15, wherein said first synchronization wheel is rotatably mounted on a shaft at said central rail, said overload protection device being formed at least partly of said pinion gear of said first synchronization wheel.

20. The extension guide according to claim 15, wherein said first synchronization wheel and said second synchronization wheel are coupled together so as to rotate at the same speed and at the same times when the predetermined torque is not exceeded.

21. The extension guide according to claim 15, wherein said overload protection device comprises a coupling including a first latching wheel and a second latching wheel configured to remain in position relative to each other below the predetermined torque, said first latching wheel and said second latching wheel being made of plastic having different hardnesses so that said first latching wheel is more flexible than said second latching wheel to allow uncoupling of said first latching wheel from said second latching wheel above the predetermined torque.

22. The extension guide according to claim 15, wherein said overload protection device includes:

a first latching wheel having a recess forming an inner circumferential surface coaxial with said shaft, and having an outer circumferential surface with teeth forming said first synchronization wheel; and a second latching wheel connected to said second synchronization wheel such that said second latching wheel is non-rotatable with respect to said second synchronization wheel, said second latching wheel being arranged within said recess of said first latching wheel such that an outer circumferential surface of said second latching wheel meshes with said inner circumferential surface of said first latching wheel.

23. The extension guide according to claim 22, wherein said inner circumferential surface of said first latching wheel and said outer circumferential surface of said second latching wheel are configured to:

remain engaged with each other so that no relative movement between said first latching wheel and said second latching wheel occurs when a torque no greater than a predetermined torque is applied between said first synchronization wheel and said second synchronization wheel, and disengage from each other so that said first latching wheel rotates relative to said second latching wheel when a torque greater than a predetermined torque is applied between said first synchronization wheel and said second synchronization wheel.

* * * * *